US010794319B2

(12) United States Patent
Behrendt

(10) Patent No.: US 10,794,319 B2
(45) Date of Patent: Oct. 6, 2020

(54) METHOD FOR CALIBRATING A FUEL PUMP FOR AN INTERNAL COMBUSTION ENGINE

(71) Applicant: CONTINENTAL AUTOMOTIVE GMBH, Hannover (DE)

(72) Inventor: Gerald Behrendt, Frankfurt am Main (DE)

(73) Assignee: Vitesco Technologies GmbH, Hannover (DE)

( * ) Notice: Subject to any disclaimer, the term of this patent is extended or adjusted under 35 U.S.C. 154(b) by 8 days.

(21) Appl. No.: 15/623,528

(22) Filed: Jun. 15, 2017

(65) Prior Publication Data

US 2017/0284330 A1 Oct. 5, 2017

Related U.S. Application Data

(63) Continuation of application No. PCT/EP2015/079269, filed on Dec. 10, 2015.

(30) Foreign Application Priority Data

Dec. 17, 2014 (DE) ..... 10 2014 226 259

(51) Int. Cl.
*F02D 41/30* (2006.01)
*F02D 41/24* (2006.01)
(Continued)

(52) U.S. Cl.
CPC ..... *F02D 41/3082* (2013.01); *F02D 41/123* (2013.01); *F02D 41/2432* (2013.01);
(Continued)

(58) Field of Classification Search
CPC ..... F02D 41/3082; F02D 41/123; F02D 41/2432; F02D 41/2438; F02D 41/2441;
(Continued)

(56) References Cited

U.S. PATENT DOCUMENTS

2013/0166482 A1* 6/2013 Veit ..... F02D 41/1402 706/12
2014/0105758 A1* 4/2014 Sausner ..... F02D 41/221 417/44.11

FOREIGN PATENT DOCUMENTS

CN 1140234 A 1/1997
CN 102505996 A 6/2012
(Continued)

OTHER PUBLICATIONS

International Search Report and Written Opinion dated Mar. 1, 2016 from corresponding International Patent Application No. PCT/EP2015/079269.

(Continued)

*Primary Examiner* — Erick R Solis
*Assistant Examiner* — Robert A Werner

(57) ABSTRACT

A method for operating an internal combustion engine, in which fuel is supplied to the internal combustion engine by a rotary pump, and the speed of the pump and/or the electrical current for feeding the pump (pump current) is controlled in accordance with a requirement variable, taking into account a determination specification. When in an overrun mode, a calibration is carried out and the speed of the pump is detected and is maintained during the calibration step. Once the triggering pressure for a calibration valve, arranged on the high-pressure side of the pump, has been reached, the pump current is detected and the determined speed and the determined pump current are used to calibrate the determination specification. A calibration in the overrun mode is performed without alteration to the speed of the fuel pump. This prevents a variable behaviour of the fuel pump which might produce undesired operating conditions.

8 Claims, 3 Drawing Sheets

(51) Int. Cl.
*F02D 41/38* (2006.01)
*F02D 41/12* (2006.01)
*F02M 37/08* (2006.01)

(52) U.S. Cl.
CPC ..... *F02D 41/38* (2013.01); *F02D 41/3809* (2013.01); *F02M 37/08* (2013.01); *F02D 2041/389* (2013.01)

(58) Field of Classification Search
CPC .. F02D 41/2451; F02D 41/2464; F02D 41/38; F02M 37/08
USPC ..... 123/325, 495, 497–499; 73/114.41
See application file for complete search history.

(56) References Cited

FOREIGN PATENT DOCUMENTS

| | | | |
|---|---|---|---|
| CN | 102562384 | A | 7/2012 |
| CN | 104053893 | A | 9/2014 |
| DE | 102004006694 | A1 | 8/2005 |
| DE | 102007033858 | A1 | 1/2009 |
| DE | 102007057452 | A1 | 6/2009 |
| DE | 102010030872 | A1 | 1/2012 |
| EP | 1637723 | A1 | 3/2006 |
| WO | 2012089400 | A1 | 7/2012 |

OTHER PUBLICATIONS

German Office Action dated Jun. 12, 2015 for corresponding German Patent Application No. 10 2014 226 259.3.
Chinese Office Action dated Aug. 14, 2019 for corresponding Chinese patent application No. 201580067270.7.

* cited by examiner

METHOD FOR CALIBRATING A FUEL PUMP FOR AN INTERNAL COMBUSTION ENGINE

CROSS-REFERENCE TO RELATED APPLICATIONS

This application claims the benefit of PCT Application PCT/EP2015/079269, filed Dec. 10, 2015, which claims priority to German Application DE 10 2014 226 259.3, filed Dec. 17, 2014. The disclosures of the above applications are incorporated herein by reference.

FIELD OF THE INVENTION

The present invention lies in the field of mechanics and mechanical engineering and may be used particularly advantageously in automotive engineering, but also in other fields in which internal combustion engines are used. Additionally, the present invention relates to a method for operating an internal combustion engine using a fuel pump.

BACKGROUND OF THE INVENTION

In modern internal combustion engines which are driven by means of internal combustion engines or are at least partially driven by means of internal combustion engines, use is normally made of engines which are supplied with fuel by means of a fuel pump, wherein the operating parameters of the fuel pump are controlled for an optimization of the operation of the fuel pump in a manner dependent on ambient conditions and on a load demand. Such as, for a controlled combustion, it is important for a certain fuel pressure to be generated on the inlet side of the fuel injection means/injection pump.

For this purpose, it is also known for such fuel pumps to be controlled on the basis of characteristic maps. Such a method is described for example in the German laid-open specification DE 198 53 823 A1. In this document, a fuel pump is controlled by means of a characteristic map such that a setpoint pressure is attained in a pressure accumulator.

The German laid-open specification DE 101 49 237 A1 has disclosed a regulation method for operating an internal combustion engine with direct injection, in which regulation method a switch is made between multiple operating modes and the control of a fuel pump is correspondingly selectively based on different characteristic curves.

For methods for controlling fuel pumps, the following problems arise in the course of an optimization:

Firstly, it is sought to dispense with a direct pressure measurement by means of a sensor in the low-pressure circuit, by means of which fuel is supplied to the high-pressure fuel pump, in order to reduce costs and outlay in terms of construction. For this purpose, methods are used which determine and set the pressure on the pressure side of the fuel pump by means of the operating parameters of the pump and other influential variables using mathematical determination methods and/or characteristic maps.

On the other hand, such determination methods and characteristic maps are subject to change as a result of wear of pump parts and other parts of the fuel circuit, and furthermore, it is not possible for all influential variables to be directly measured and included in a multi-dimensional characteristic map.

For this reason, a restriction to one characteristic map of the fuel pump is normally implemented, and it is sought to adapt the characteristic map, by means of a calibration measurement, to the other variables not resolved in the characteristic map and to the other conditions. The required calibration measurements may for example be performed when the internal combustion engine is set in operation, for example upon the start of a journey with a motor vehicle, and refined by means of further calibration measurements.

For example, it has become known for a reference valve to be provided between the high-pressure pump of an injection means and the internal combustion engine, the pressure behavior of which reference valve is known, that is to say which reference valve opens when a certain reference pressure is exceeded. Such a valve may be driven by means of targeted variation of operating parameters of the high-pressure pump such that the opening of the valve is identified and thus, under certain operating conditions, the attainment of the reference pressure is registered. Such calibration methods are supplemented and refined in order that not only the gradient of reference curves but also the spread of a characteristic map is determined.

SUMMARY OF THE INVENTION

Against the background of the prior art, the present invention is based on the object of integrating the calibration of a fuel pump, which may for example be arranged in a tank, into an overrun operating mode.

Overrun operation is to be understood to mean operation the internal combustion engine in which the latter does not drive an external load, with the internal combustion engine rather either transitioning from a load state to an idle state or being driven by the load itself, that is to say for example when, in the case of a motor vehicle travelling downhill, the internal combustion engine is used as an engine brake, or a situation, during normal travel, in which the accelerator pedal is not actuated and the rotational speed of the internal combustion engine is determined only by the speed of the vehicle itself. In such states, the optimum operating parameters of a fuel pump are particularly difficult to determine.

The object is achieved according to the invention by means of a method for operating an internal combustion engine as per patent claim 1. Subclaims 2 to 11 specify advantageous refinements of the invention. Patent claim 12 relates to a drive system according to the invention which is provided for the use of the method according to the invention.

Specifically, the invention thus relates to a method for operating an internal combustion engine, in which method fuel is supplied to the internal combustion engine by means of a rotating pump, and in which method the rotational speed of the pump and/or the electrical current for feeding the pump (pump current) is controlled in a manner dependent on a demand variable, taking into consideration a determination specification, such as a characteristic map, wherein, to achieve the object, in the event of a change in operating mode to overrun operation, a calibration is performed, wherein the rotational speed of the fuel pump is detected and is maintained substantially unchanged during the calibration, wherein, in the event of the triggering pressure of a calibration valve arranged on the pressure side of the pump being attained, the pump current is detected, and wherein the determined rotational speed and the determined pump current are used for the calibration of the determination specification.

Normally, upon a change to overrun operation of an internal combustion engine, the rotational speed and thus also the delivery power of the pump (=fuel pump) arranged between the intake line in the tank and a high-pressure injection pump of the engine is reduced, because the fuel consumption and thus the extraction of fuel on the engine side of the fuel pump tends to zero. In order to perform a calibration in such a state, it would normally be the case that one of the operating parameters of the fuel pump is varied (voltage in the case of fuel pumps operated with direct current/rotational speed setpoint in the case of electronically regulated fuel pumps), which would result in any case in a variable behavior of the pump, for example with a certain rotational speed range being run through. Such behavior may firstly result in the system of the internal combustion engine assuming states which are unfavorable upon the transition to normal operation, and secondly, in a usage situation in a motor vehicle, such variation of the operating parameters of the fuel pump are in part perceptible to, and perceived as unpleasant by, the driver.

In the method according to the invention, the rotational speed of the fuel pump is, after the transition to overrun operation, kept constant or constant at least for a short time (<2 sec, but typically at least 0.2 sec, in particular at least 0.5 sec), such that no noticeable change in the behavior of the fuel pump occurs.

For this purpose, it is for example possible for the change to overrun operation to be detected by means of the engine control electronics (ECU), sensors or else directly by means of the behavior of the internal combustion engine or a sensor at the accelerator pedal, and to be transmitted to a controller of the fuel pump. This may be realized for example via a CAN bus, such as is often present in vehicles, by means of electrical signals, such as digital commands. The rotational speed of the fuel pump is thereupon not changed, or is changed only to a small extent, for example in order to attain a particular rotational speed which is close to the rotational speed upon the transition to overrun operation, and for which, for example, a characteristic curve is present, or which constitutes a value suitable for the calibration. The rotational speed of the fuel pump should advantageously be changed by no more than 10%, in particular no more than 5%, furthermore in particular no more than 2%, after the transition to overrun operation. The fuel pump is then operated for a time period at the constant rotational speed thus attained. Since the demand for fuel on the high-pressure side is close to zero or is even equal to zero during overrun operation, a so-called overshoot state arises in which the pressure between the fuel pump to be calibrated and a high-pressure pump increases for the injection itself. Here, in the presence of a constant rotational speed of the pump, the pump current changes (increases), that is to say the current which serves for driving an electric motor of the pump increases. (A higher pressure entails more energy and thus demands a higher pump current). Owing to the fact that no quantity is extracted, the pressure rapidly increases (overshoot), and, during the overshoot, as soon as the triggering pressure of a calibration valve arranged in the fuel tank on the discharge side of the pump to be calibrated is attained, the calibration valve opens, and the attainment of the pressure is detected. The pressure value is identified from a stoppage of the increase of the electric pump current. The pump current attained at this working point is stored together with the rotational speed. Thus, a data triplet of a characteristic map is known which links the pressure of opening pressure of the valve, which as a characteristic of the valve is also dependent on the volume flow, to the present rotational speed of the pump and to the pump current (kink of the characteristic curve). The mediating variable is in this case the volume flow, which has an influence on the opening pressure of the calibration valve and is determined from the pump rotational speed. Since the triggering/opening pressure of the calibration valve is dependent on the volume flow, it is possible, after attainment of the opening pressure, for the determined volume flow to be used to correct the opening pressure of the calibration valve by means of an estimation. Thus, it is also the case that different value pairs are obtained for different rotational speeds.

The first calibration may be supplemented/replaced by subsequent further calibrations if a further change from normal operation under load to overrun operation occurs, wherein it is then for example the case that the fuel pump is in each case at a different rotational speed depending on the load behavior before overrun operation, and a further data triplet is determined corresponding to the rotational speed or to a rotational speed lying close to the rotational speed. By means of at least two calibration measurements, it is possible for gradients of the characteristic curves of the characteristic map to be determined, and such as if, by means of measurements at different rotational speeds, different switching pressures of the calibration valve are utilized, it is also possible for a spread of the characteristic map to be determined.

In this context, the demand variable may be understood, in the control of the fuel pump and of the internal combustion engine, to be the power or the torque demanded of the internal combustion engine, wherein the variable is represented for example by the degree of actuation of an accelerator lever/accelerator pedal.

A prerequisite for an expedient execution of the described calibration process is that the rotational speed of the fuel pump has, at the transition to overrun operation, a certain minimum value which actually leads to an overshoot of the pressure on the high-pressure side of the pump.

Therefore, an advantageous refinement of the invention provides that, after identification of the change in operating mode to overrun operation, the rotational speed is determined, and a calibration is performed only under the condition that a defined rotational speed threshold is exceeded. In this way, in the event of changes to overrun operation in the case of which the rotational speed of the fuel pump is particularly low, an attempt at calibration is omitted.

It is advantageously furthermore provided that, after identification of the change in operating mode to overrun operation, the rotational speed is determined, and the rotational speed is reduced, the pump is deactivated, under the condition that a defined rotational speed threshold is undershot.

In order to save fuel, the pump may be deactivated entirely, wherein, in the presence of certain prerequisites, it may also be advantageous for a certain minimum rotational speed to be maintained in order to facilitate a subsequent change from overrun operation to normal operation under load. For example, an idle phase during a gearchange in a gearbox in a motor vehicle should not necessarily lead to the fuel pump being temporarily deactivated.

In the event of a calibration being started, it is possible firstly for the actual rotational speed of the fuel pump to be maintained until the calibration valve switches during the course of the overshoot. If a multiplicity of parameters in a determination specification is adapted by the calibration, it is often not necessary for the data sets to be determined upon attainment of the switching pressure of the calibration valve at certain rotational speeds. However, if it is sought to calibrate a particular characteristic map, it is often the case there that characteristic curves are predefined at certain rotational speed values, such that it may be advantageous to set a closely lying predefined rotational speed for calibration purposes. The set of the defined rotational speed values available for selection then correspond to the individual spread-apart characteristic curves.

A further advantageous embodiment of the invention provides that, after the determination of a pump current, upon the triggering of the calibration valve, it is checked whether the number of calibration points has reached a predefined minimum number. A single calibration measurement is normally not sufficient for a calibration, for the reasons mentioned above, such that it is expedient for at least two calibration measurements, ideally three calibration measurements, to be performed. To increase accuracy, it is also possible for an even greater number of calibration measurements, for example four or five measurements, to be performed. If the desired number of calibration measurements has been reached, the controller of the fuel pump can register this, use the correspondingly calibrated characteristic map as a basis for the further control, and omit the execution of further calibration measurements in the event of future changes to overrun operation until the next stoppage of operation of the engine.

Furthermore, during each individual calibration measurement, it may advantageously be provided that, after the calibration, the rotational speed of the pump is reduced, and in one embodiment, the pump is deactivated. In this way, the consumption of fuel is reduced, for example to zero, or the fuel pump is placed into a state of low rotational speeds, which makes a change to a load state again straightforward.

The invention may advantageously also be refined such that, during an ongoing calibration, as soon as overrun operation is ended, such as a result of a change in the demand variable, it is determined to what extent the calibration has progressed, the calibration is ended, and, in a manner dependent on the progress of the calibration, the determined values are taken into consideration in a weighted manner.

It may be provided that, even in overrun operation, after a first calibration, a variation of the rotational speed is performed in order to adjust to one or more further calibration operating points.

Even in the presence of only a single reference point of the calibration, it is possible, by means of a slow reduction of the rotational speed after the successful measurement, for a further calibration point (closure of the valve after opening during the course of the first calibration and utilization of a hysteresis effect (=pressure difference between opening and closing)) to be recorded.

A further advantageous embodiment of the invention provides that, during an ongoing calibration, as soon as overrun operation is ended, such as as a result of a change in the demand variable, it is determined to what extent the calibration has progressed, the calibration is immediately ended, and, in a manner dependent on the progress of the calibration, the determined values are not taken into consideration. If a demand for a load is made before the triggering of the reference valve, normal operation under load is commenced without a data triplet for the calibration having been detected. Thus, no calibration measurement is performed, and the calibration process must be discarded at this juncture.

A further advantageous embodiment of the invention may provide that the change to overrun operation is transmitted to the pump controller by means of electronic signals, such as by means of a bus system. The use of a CAN bus for such signal transmission has already been discussed further above. In this regard, it should also be noted that the data and the activation of the calibration do not imperatively have to be performed in the pump control unit, it rather also being possible for the items of information to be distributed or to be determined in the vehicle and for the process to be performed, controlled or evaluated by the engine control unit or, more generally, by a software module in an assembly of the vehicle.

Furthermore, the invention may advantageously be refined such that, before or during a calibration, the rotational speed of the pump is changed so as to assume a value from a predefined set of fixed values, in the case of which no calibration measurement has yet been performed. For example, if, upon the change to overrun operation, a rotational speed of the fuel pump is present at which a data triplet, composed of rotational speed, pump current and switching pressure of the reference valve, has already been determined in an earlier calibration measurement, it is possible for the rotational speed to be changed to such an extent that a rotational speed value which is not unduly remote from the original rotational speed and for which a further calibration measurement is expedient is attained.

For example, a number of different rotational speeds may be defined in steps of 100, 200 or 500 revolutions per minute and stored in a memory of the control device of the fuel pump or in some other control module in the vehicle, for example in the engine controller. It is then possible, upon every calibration, for the closest rotational speed from the set of stored rotational speeds to be selected and adjusted to. At each of the rotational speeds, it is then for example possible for only one or two calibration measurements to be performed in order to then be able to use averaged calibration triplet/calibration tuples.

A further advantageous embodiment of the invention may consist in that the rotational speed of the pump is reduced in order to attain a value from the predefined set of fixed values, in the case of which no calibration measurement has yet been performed. In this case, the rotational speed is at any rate kept constant or reduced, but not increased, upon the change to overrun operation. The setting of the rotational speed at which the calibration takes place then constitutes an intermediate stage between the initial rotational speed of the fuel pump and a resting rotational speed which is set after the calibration in the event of continuation of overrun operation. If the rotational speed of the pump is very high upon the transition to overrun operation, the rotational speed may also be reduced, before the start of the calibration, to an approximate value which is expedient for the system. Then, the rotational speed remains constant for the calibration process itself.

If, for the execution of the calibration, the rotational speed is lowered slightly, then it must in any case also be checked whether the rotational speed thus adjusted to still lies above a critical minimum rotational speed which leads to an overshoot, that is to say in the case of which the overshoot of the pressure on the engine side of the pump to a value higher than the triggering pressure of the reference valve actually occurs.

The invention relates not only to a method of the type described above but also to a drive system having an internal combustion engine to which fuel is supplied by means of a rotating pump, and in which the rotational speed of the pump and/or the electrical current for feeding the pump (pump current) is controlled in a manner dependent on a demand variable, taking into consideration a determination specification, such as a characteristic map, and having a calibration device for calibrating parameters of the determination specification, wherein the calibration device has: an actuation device which keeps the rotational speed of the pump at a constant value, a detection device which detects the triggering of a calibration valve, a measurement device which determines the pump current, and a correction determining device which determines a correction variable of the determination specification from one or more calibrations.

Such drive systems are suitable for the method according to the invention if no pressure sensor is provided on the engine side of the fuel pump, that is to say on the side to which the pump delivers the fuel, between the pump and the internal combustion engine. However, the implementation is basically also possible if a pressure sensor is provided. In this case, the described calibration then serves for plausibility checking of the fuel pressure sensor. For the calibration according to the invention, use is made only of the triggering characteristic of a reference valve which opens or partially opens in the presence of a certain fuel pressure, such that the behavior is directly or indirectly verified by a detection device through evaluation of measurement values, and the attainment of the corresponding pressure is registered. The detection device which detects the triggering of the calibration valve is conceivable as an evaluation device which, for example in the event of an increase of the pump current in the presence of a constant pump rotational speed, registers a kink in the characteristic curve which illustrates the profile of the pump current in relation to the rotational speed. It is however also possible for a sensor to be provided which actually and directly verifies a reaction of the calibration valve, for example by means of a position sensor which detects the position of a closure body of the valve, or by means of a fluid flow sensor, which registers the onset of a volume flow upon opening of the valve.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Below, on the basis of an exemplary embodiment, the invention will be shown in the figures of a drawing and discussed below. The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
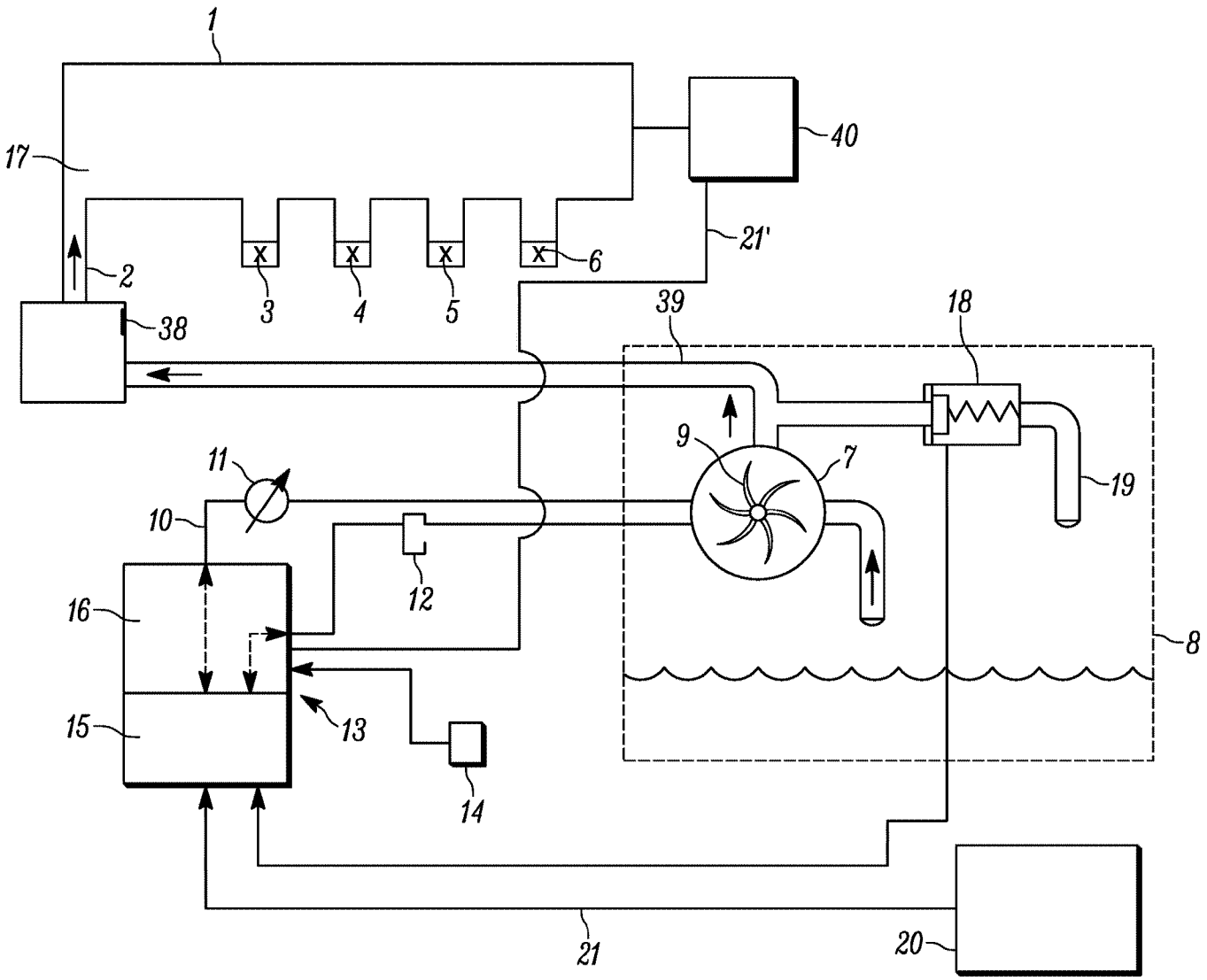
FIG. 1 schematically shows the construction of an internal combustion engine, of a fuel pump, of a high-pressure pump and of corresponding control and sensor devices.

FIG. 1 shows an internal combustion engine 1 which is controlled by means of an engine controller (ECU) 40 and which, via a fuel line 2, is supplied with fuel at high pressure by means of the high-pressure pump/injection pump 38, wherein the fuel is injected into individual cylinders (not illustrated) by means of four injection valves 3, 4, 5, 6. For this purpose, fuel is supplied to the high-pressure pump 38 from a tank 8 via a low-pressure circuit 39 by means of the fuel pump 7. It is the intention in the method according to the invention to calibrate the fuel pump 7, which may be arranged in the tank 8. The pump 7 is driven by means of an electric motor integrated therein, and has a rotor 9 for delivering the fuel. The rotor is schematically illustrated, wherein, for example, a positive-displacement pump or some other pump embodiment may be used as the pump.

The electric motor of the pump 7 is fed with a current (pump current) via an electrical line 10, wherein the current intensity is detected by means of a current sensor 11. The rotational speed of the pump is detected by means of a sensor 12, or the rotational speed is determined on the basis of the current information from 11, and transmitted to a control device 13 of the pump (pump controller). The control device 13 is actuated with the demand variable by means of an accelerator pedal 14, and, in the actuation of the pump 7, takes into consideration both the rotational speed of the pump rotor 9, which is transmitted by the sensor 12, and the current intensity of the pump current. For this purpose, the controller 13 has a data processing part 15 in which corresponding determination algorithms and/or characteristic maps are stored. The remaining part 16 of the control device 13 performs the actuation of the pump 7.

To the low-pressure circuit 39, which is at an elevated fuel pressure in relation to the tank 8 and situated between the fuel pump 7 at one side and the high-pressure pump 38 and the engine 1 at the other side, there is connected a reference valve 18, which may be arranged in the fuel tank 8 and which, in the event of an exceedance of a reference pressure, opens and discharges fuel via an outlet duct 19. The reference valve 18, which itself may be situated outside the tank, is used in the manner according to the invention for calibrating the controller 13 and/or the data processing part 15. The calibration process may be controlled by means of the engine controller 40 or the pump controller or a software module integrated in some other assembly of the vehicle.

Figure 3:
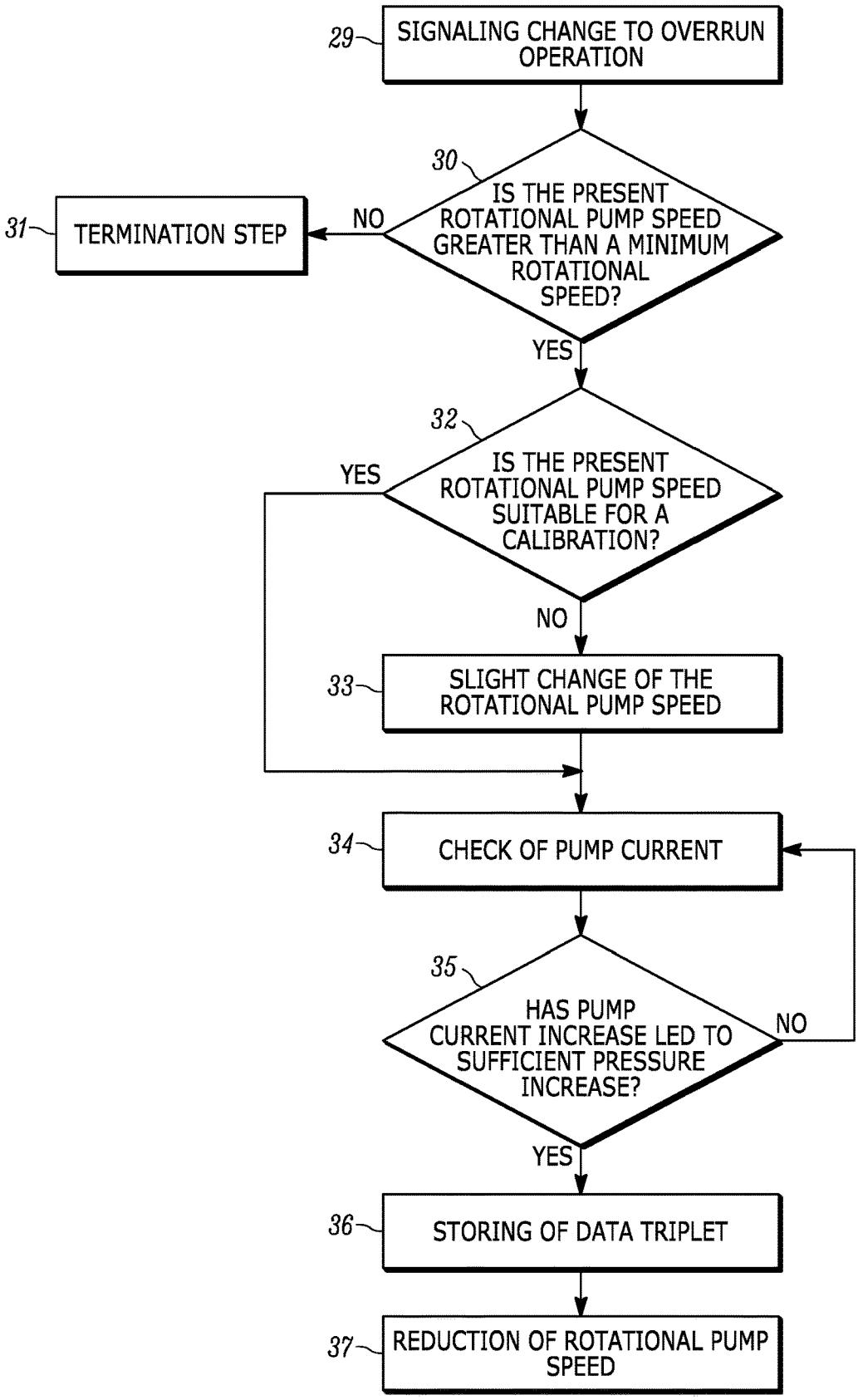
FIG. 3 shows a flow diagram of a process according to the invention.

In addition to the input variables of the load demand from the accelerator pedal 14, the rotational speed of the pump 7, the pump current and possibly other influential variables such as the air humidity and the operating temperature, the control device 13 may also have the rotational speed of the internal combustion engine transmitted thereto from the rotating part 20 of the internal combustion engine. The engine or the engine controller may for example transmit a signal to the control device 13 via a CAN bus 21, 21', which signal signalizes the rotational speed and possibly the change to overrun operation. For the identification of overrun operation, a signal from the accelerator pedal 14 may also be concomitantly processed. The process of the calibration will be discussed in more detail further below on the basis of FIG. 3.

Figure 2:
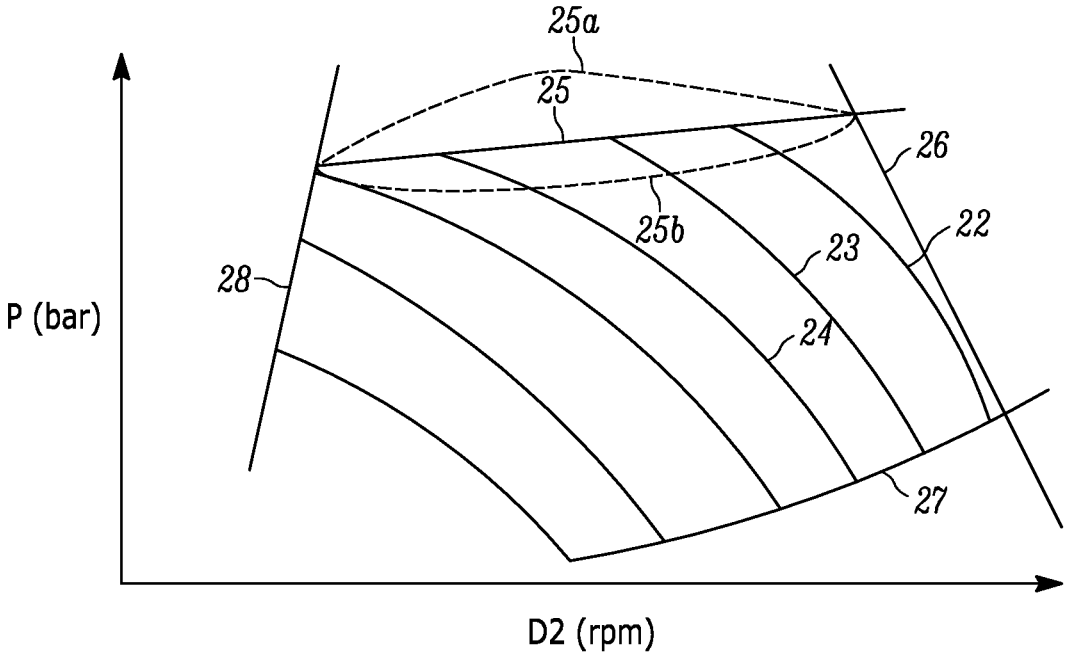
FIG. 2 shows a typical characteristic map of a fuel pump.

FIG. 2 illustrates a diagram in which the fuel pressure p in bar is plotted on the y axis versus the rotational speed on the x axis, measured in revolutions per minute. Multiple curves/characteristic curves 22, 23, 24 are shown, each of which represents a fixed current intensity value of the pump current, that is to say of the current which is fed to the electric motor which drives the pump. For each individual one of the characteristic curves 22, 23, 24, the relationship between the fuel pressure and the rotational speed of the pump is illustrated. The upper boundary line 25 of the diagram denotes, in simplified form and disregarding any hysteresis (see below), the triggering pressure of the reference valve, that is to say, as soon as the fuel pressure crosses the boundary in the direction of higher pressures, the reference valve opens, and the pump cannot generate any higher pressure. The two dashed lines 25*a* and 25*b* are illustrated merely schematically and not to scale, and indicate triggering pressure values of the reference/calibration valve, with more detailed consideration being given to a hysteresis, that is to say, in the event of an increase of the pressure, the valve opens only in the presence of the higher of the two pressure values (lying on the line 25*a*), whereas in the event of a decrease of the pressure, the valve closes again in the presence of the relatively low pressure value (lying on the line 25*b*).

To expand the calibration possibilities, it is possible, in an overshoot process during overrun operation, to detect not only the triggering of the reference valve in the event of the pressure increase but also the switching pressure of the valve in the event of the pressure decrease, and thus, in a single process, to record two reference points in each case with pump rotational speed/pump volume flow and pump current.

The boundary line 26 denotes the maximum rotational speed that may be achieved by the fuel pump, and the boundary line 27 denotes the values of the maximum delivery quantity that is achieved by means of the pump, and the line 28 denotes the limit of the delivery quantity of the pump that cannot be undershot, for example if the pump is a positive displacement pump.

Corresponding characteristic maps in another representation but with the same information content also exist for lines of constant rotational speed of the pump, wherein, in this case, the current intensity is variable.

If, in the presence of constant rotational speed, the current intensity is increased, the pressure increases up to the line 25, or more specifically the line 25*a*, and when the triggering pressure of the reference pump is reached, the set rotational speed of the pump, and the current intensity of the pump current attained at this point, are present, such that a data triplet composed of the three values pump current, rotational speed and pressure are stored as a reference. For this purpose, it must furthermore be considered that the triggering pressure of the pump, illustrated by the line 25, is not independent of the rotational speed of the pump, such that the triggering pressure may be corrected on the basis of the rotational speed and the pump current.

Measurements of different data triplets, that is to say different current intensities at different rotational speeds of the pump in each case upon the attainment of the triggering pressure of the reference valve (according to the invention, in the presence of a constant rotational speed of the pump) make it possible for the entire characteristic map to be calibrated. The method according to the invention will be discussed by way of example for one possible embodiment on the basis of FIG. 3.

In a first step 29, the pump controller 13 or some other responsible module in an assembly of the vehicle signals that a change to overrun operation is presently taking place or has taken place. In the second step 30, it is checked whether the present rotational speed of the pump 7 lies above a minimum rotational speed required for the calibration.

If this is not the case, the calibration method is stopped by means of a transition to a termination step 31, and it is for example possible for the fuel pump to be run down to a rotational speed of zero or to a low rotational speed. If the rotational speed of the pump lies above the threshold value, then in the next method step 32, it is checked whether the present rotational speed of the pump is suitable for a calibration, and whether a calibration point already exists for the rotational speed. If the rotational speed is suitable for a calibration and if it is the case that no calibration measurement has yet been performed at the rotational speed, then a transition is made directly to step 34. If this is not the case, then in a method step 33, the rotational speed of the pump is changed slightly, is reduced to a preselected value and/or to a "round" value.

In the next method step 34, the electric pump current is then checked; as a result of the increasing pressure, the pump current also increases. This may be performed in small discrete steps or continuously. After every measured increase, it may be checked in the method step 35 whether a current increase has led to a sufficient pressure increase, or whether the reference valve has been triggered. If this is not determined directly by observing the load of the pump, then it may also be signaled by means of a sensor arranged at the calibration valve/reference valve.

If the current does not increase, or if a triggering of the reference valve is directly signaled, then a transition is made from the step 35 to a step 36, in which the data triplet composed of the current intensity of the pump current, the rotational speed and the triggering pressure of the reference valve, or a corrected value of the triggering pressure taking into consideration rotational speed and pump current, is stored. The calibration measurement point is thereupon detected, and the rotational speed of the pump may, in the final method step 37, be reduced, for example to zero. The calibration measurement may be repeated later such as at other starting rotational speeds of the pump in order to collect a multiplicity of data triplets, which can together be used to correct a characteristic map which is stored in the region 15 of the control device 13.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for operating an internal combustion engine, in which fuel is supplied to the internal combustion engine, comprising the steps of:

providing a rotating pump having a pressure side, the rotating pump having a rotational speed and a pump current;

providing a demand variable;

providing a calibration valve in fluid communication with the pressure side of the rotating pump;

providing a determination specification having a characteristic map;

providing a trigger pressure which actuates the calibration valve;

providing a predefined set of fixed values representing a plurality of rotational speeds of the rotating pump;

providing a plurality of calibration values obtained during the calibration;

changing the operating mode of the internal combustion engine to an overrun mode of operation;

performing a calibration including detecting and maintaining the rotational speed of the rotating pump, and detecting the pump current upon actuation of the calibration valve at the trigger pressure, such that the rotational speed of the rotating pump and the pump current of the rotating pump are part of the determination specification; and controlling the rotational speed of the fuel pump and the pump current for feeding the fuel pump based on the demand variable and the determination specification;

changing the rotational speed of the rotating pump during the calibration, such that that rotational speed of the rotating pump corresponds to one of the predefined set of fixed values;

changing the rotational speed of the rotating pump during the calibration, such that that the rotational speed of the rotating pump corresponds to one of the predefined set of fixed values that has not already been determined in an earlier calibration measurement;

changing the operation of the internal combustion engine as a result of a change in the demand variable such that the internal combustion engine is no longer in the overrun mode of operation;

ending the calibration as a result of the internal combustion engine is no longer being in the overrun mode of operation;

determining to what extent the calibration has progressed;

assigning a weight to the plurality of calibration values.

2. The method of claim 1, further comprising the steps of:

providing a rotational speed threshold for the rotating pump;

identifying the change in operating mode of the internal combustion engine to the overrun mode of operation;

determining the rotational speed of the rotating pump after identifying the change in operating mode of the internal combustion engine to the overrun mode of operation;

performing the calibration only when the rotational speed of the rotating pump has exceeded the rotational speed threshold.

3. The method of claim 2, further comprising the steps of deactivating the rotating pump if, after identifying the change in operating mode of the internal combustion engine to the overrun mode of operation, the rotational speed of the rotating pump is less than the rotational speed threshold.

4. The method of claim 1, further comprising the steps of:

providing a predefined set of fixed values representing a plurality of rotational speeds of the rotational pump;

before the calibration, changing the rotational speed of the rotational pump to one of the predefined set of fixed values.

5. The method of claim 1, further comprising the steps of reducing the rotational speed of the rotational pump during the calibration, such that that rotational speed of the rotational pump corresponds to one of the predefined set of fixed values that has not previously been used during the calibration.

6. The method of claim 1, further comprising the steps of:

providing a predefined minimum number of calibrations points;

determining whether the number of calibrations points has reached the predefined minimum number of calibration points after the determination of the pump current and the triggering of the calibration valve.

7. The method of claim 1, further comprising the steps of deactivating the fuel pump after completion of the calibration.

8. The method of claim 1, further comprising the steps of:

providing a bus system; and providing a pump controller operable for controlling the fuel pump;

communicating the change to the overrun mode of operation of the internal combustion engine to the pump controller using the bus system.

* * * * *